United States Patent [19]

Jones-Fenleigh

[11] 4,171,756

[45] Oct. 23, 1979

[54] APPARATUS FOR THE METERING AND DISPENSING OF PRODUCTS

[75] Inventor: Edward J. Jones-Fenleigh, Oadby, England

[73] Assignee: Invicta Plastics Limited, Oadby, England

[21] Appl. No.: 779,000

[22] Filed: Mar. 18, 1977

[30] Foreign Application Priority Data

Mar. 20, 1976 [GB] United Kingdom ..... 11339/76

[51] Int. Cl.[2] ..... B65D 87/28

[52] U.S. Cl. ..... 222/217; 222/637

[58] Field of Search ..... 222/194, 193, 217, 306, 222/356, 405; 302/48

[56] References Cited

U.S. PATENT DOCUMENTS

| | | | |
|---|---|---|---|
| 1,305,726 | 6/1919 | Leonard et al. | 302/25 X |
| 2,383,536 | 8/1945 | Elliott | 222/217 X |
| 3,312,374 | 4/1967 | Whitlock | 222/356 X |
| 3,656,518 | 4/1972 | Aronson | 222/194 X |
| 3,837,540 | 9/1974 | Wagener | 222/193 |
| 3,858,763 | 1/1975 | Mack | 222/193 |
| 3,913,795 | 10/1975 | Coucher et al. | 222/194 |

*Primary Examiner*—Robert J. Spar
*Assistant Examiner*—Francis J. Bartuska
*Attorney, Agent, or Firm*—Charles E. Brown

[57] ABSTRACT

The invention provides apparatus for scooping a number of small articles or a small quantity of particulate material from a larger reservoir thereof, the volume of the amount scooped and therefore its quantity being regulated by adjusting the capacity of the scoop. In a preferred example of the invention a number of scoops work simultaneously in separate reservoirs and eject the scoopfuls into a common outlet when they are swept to a packaging point by a swift current of air.

3 Claims, 7 Drawing Figures

APPARATUS FOR THE METERING AND DISPENSING OF PRODUCTS

BACKGROUND OF INVENTION

The invention is concerned with apparatus for the metering and dispensing of products comprising small articles, particulate material or the like from a supply thereof.

It is frequently required in industrial processes producing a supply of small articles, components, particulate material or even tablets or capsules in the pharmaceutical industry, for the product to be measured in more or less exact, pre-determined quantities, for example, for packaging prior to distribution.

It has been proposed, in the case of small articles produced say, in thousands or millions, to simplify their allocation into packages of, say, twelve or twenty, not by counting them but by weighing the products fed to a dispenser and when the desired weight has been so fed, causing a stop to become operative to separate the weighed products from the supply, ready for passage to a packaging station. This method, while reasonably satisfactory with certain products, is nevertheless prone to inaccuracies, being not versatile enough to cope with irregularly shaped products, and requires a great deal of maintenance.

It has also been proposed to monitor small products numerically, marshalling them into, say, single file and allowing a desired number to enter a chute or the like. Again, irregularly shaped articles cannot be aligned readily and tend therefore to jam in the marshalling apparatus, thereby resulting at best in short measure, or at worst in bringing the machine to a standstill.

BRIEF SUMMARY OF INVENTION

It is an object of this invention to provide apparatus, the use of which obviates the above disadvantages.

The invention therefore provides apparatus for the mertering and dispensing of products comprising small articles, particulate material or the like, comprising a supply reservoir for receiving the products from a source, a first aperture situated in a lower region of the reservoir, a second aperture in said reservoir arranged in alignment with said first aperture, a scoop device, means for causing the scoop device to pass through the reservoir entering through said first aperture, so as to collect a quantity of product during its passage between said first and second apertures, ejection means for ejecting said collected products from the scoop device so that they leave the reservoir through said second aperture.

Advantageously, the ejection means comprises a ram member positioned within the scoop, the initial position of the ram member at the commencement of the passage of the scoop device through the reservoir determining the amount of product by volume entering the scoop. It will thus be appreciated that a given number of irregularly shaped but fairly compact products such as, for example, small screws or nails, small plastics pegs and the like, will occupy a given volume and the position of the ram member determines the internal volume or cubic capacity of the scoop device.

Where a mixture of products differing in size or colour is required to be packaged, it is arranged that a plurality of apparatuses as above described are arranged in a series, each pre-set to meter and dispense the required number of products.. Ejection of the products may then be arranged to be simultaneous from each apparatus and directed into a common passageway or duct through which the products are collected, for example by gravity if the scoop device is inclined to the vertical, by suction, by a high-velocity air flow, a mechanical sweep-arm or any other convenient means. If desired the scoop devices of each apparatus may differ from each other in actual dimensions, as well as being independently adjustable in volume. In any event, the dispensed products, whether a mixture or all of a single selected type, may then be passed to a packaging station, which may conveniently be a bagging machine.

While there is no limitation in this respect, it is often advantageous if the passage of the scoop device through the reservoir has an upward component of movement, and will preferably be vertically upwards through a layer of products in the reservoir.

It is advantageous if the ejection means returns to its initial position within the scoop device before commencing a return passage towards the first aperture. Thus as the scoop device descents, the next load of products commences to enter the scoop under the influence of gravity.

Products are aided in settling into the scoop device, and so improving the accuracy of the metering, if vibrator means are provided to cause vibration of the scoop device as it travels between the two apertures.

BRIEF DESCRIPTION OF DRAWINGS

There will now be described an example of an apparatus according to the invention. It will be understood that the description, which is to be read with reference to the accompanying drawings, is given by way of example only and not by way of limitation.

In the drawings.

DETAILED DESCRIPTION OF DRAWINGS

The apparatus illustrated in the Figures is for use in the metering and dispensing of a mixture of small plastics pegs of various colours and more than one size for use with playing boards having peg-receiving apertures, as, for example, used in the playing of the game "Mastermind" (Registered Trade Mark). The pegs required are enclosed in a bag of plastics sheet material and comprise pegs of a second, smaller, size in black and in white. Approximately twelve larger pegs are required of each colour and thirty each of the smaller black pegs and white pegs.

Figure 1:
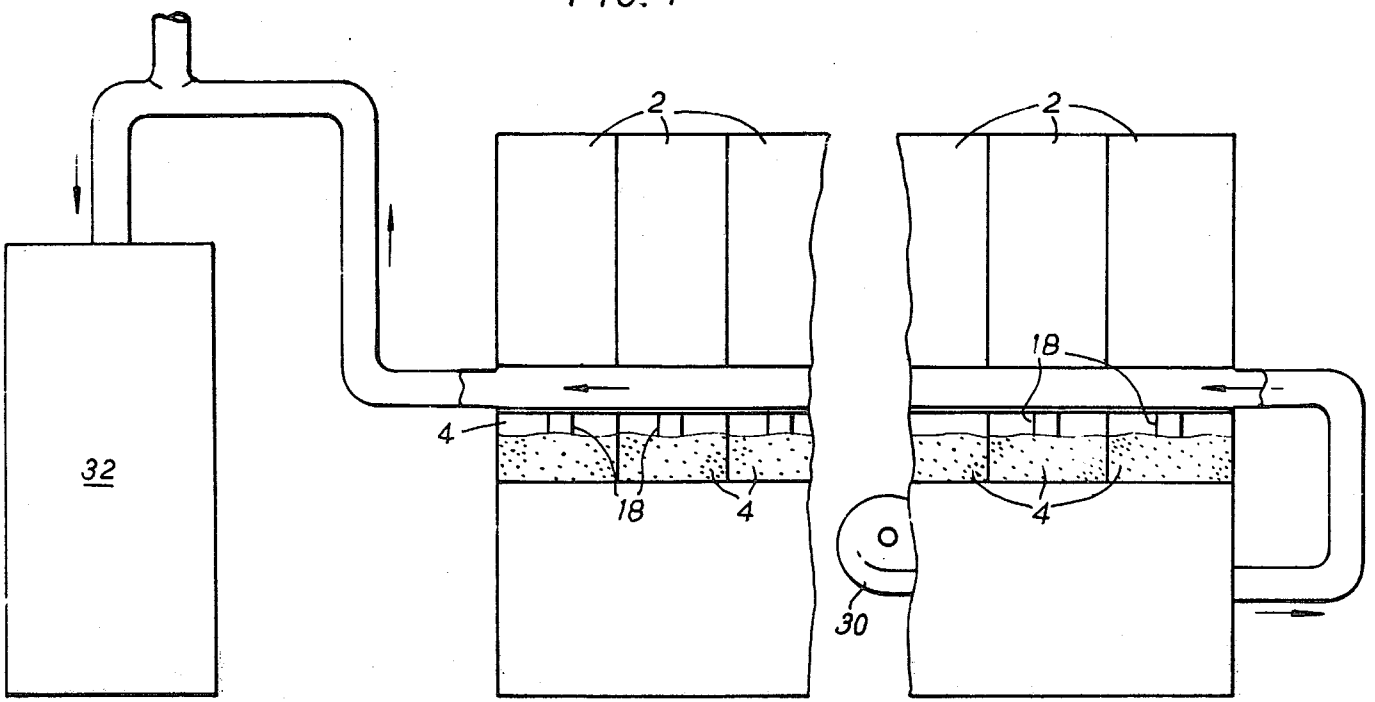
FIG. 1 is a diagrammatic representation of an apparatus arranged to meter and dispense products from a plurality of stations and pass them to a packaging station.
Figure 2:
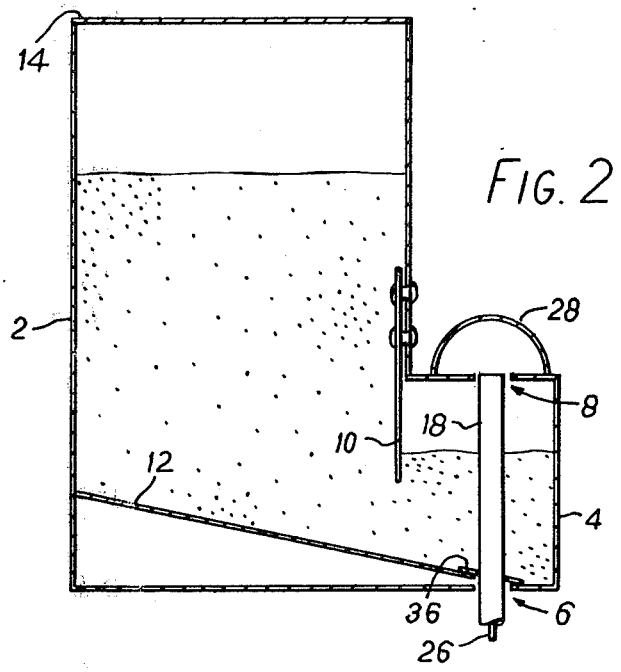
FIG. 2 is a cross-sectional diagrammatic view on line II—II of FIG. 1, to an enlarged scale.
Figure 3:
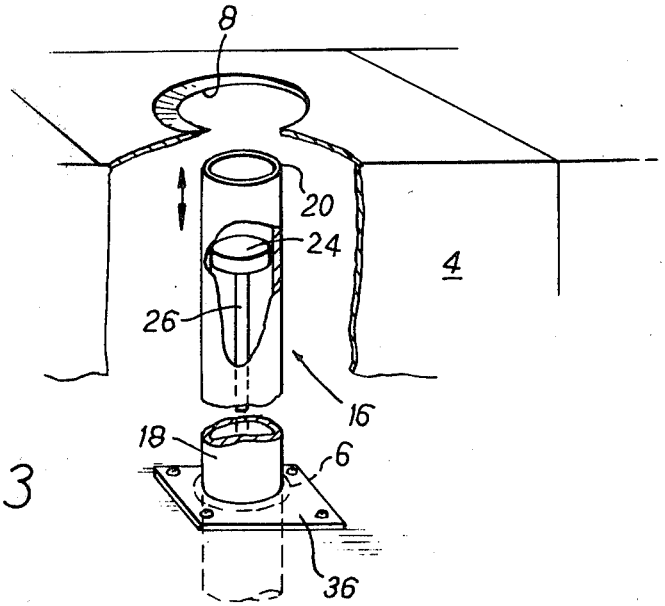
FIG. 3 is a fragmentary perspective view of a reservoir and a scoop device of the apparatus, partly broken away for the sake of clarity.
Figure 4A:
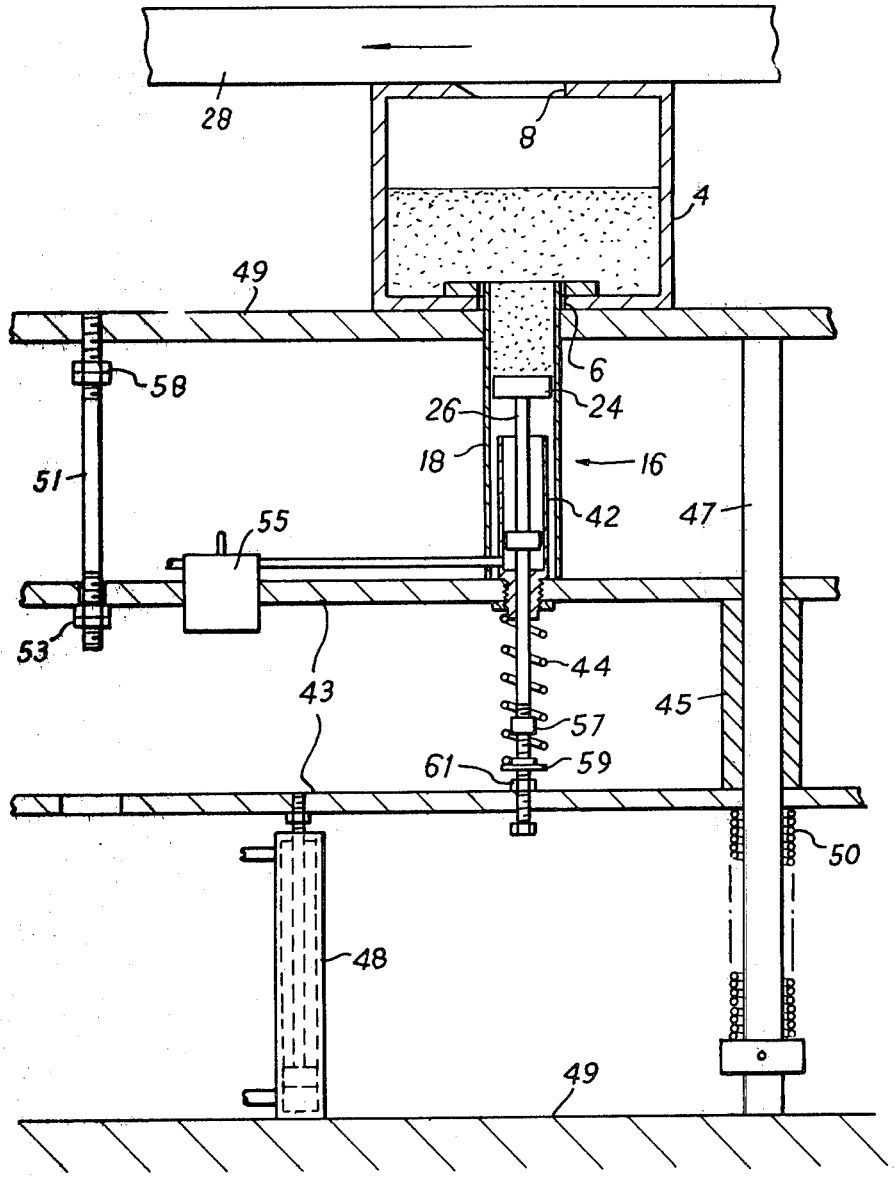
FIGS. 4*a–d* show four positions of a scoop device of the apparatus during operation.
Figure 4B:
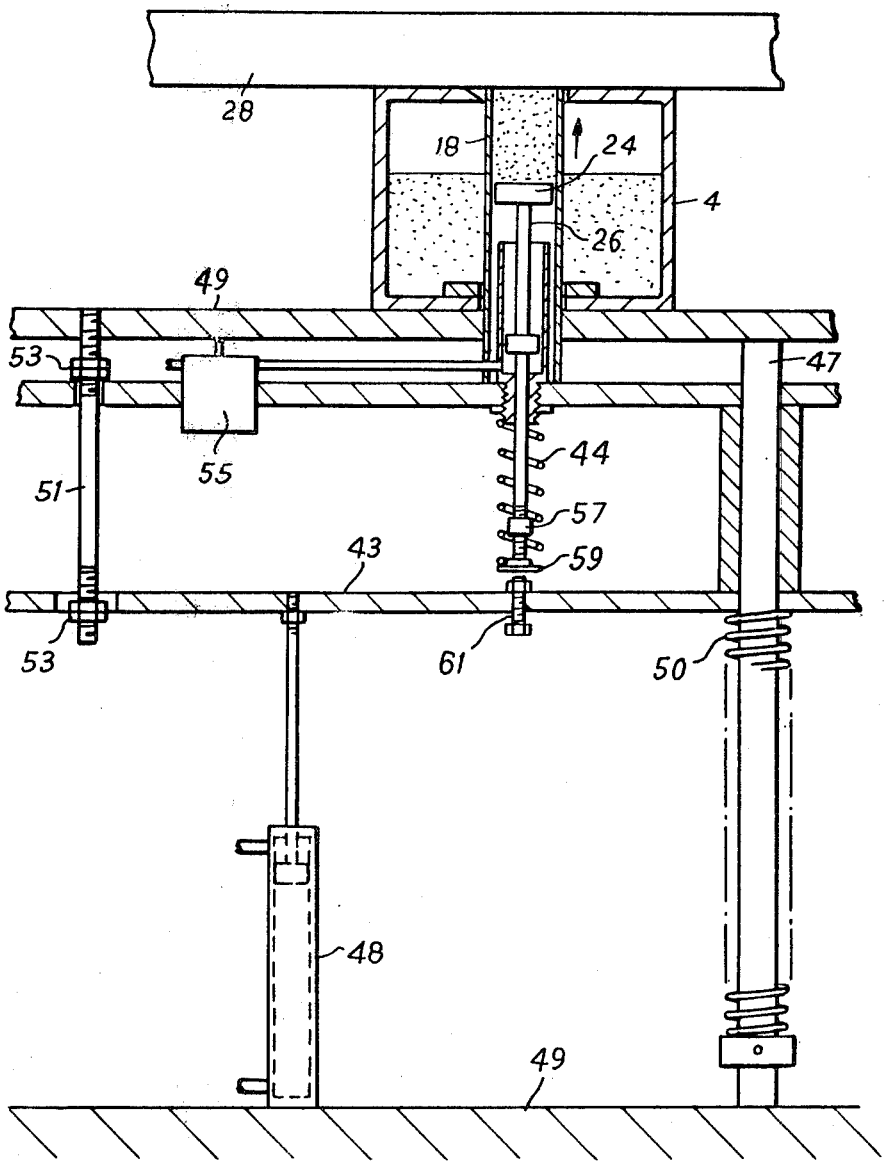
Figure 4C:
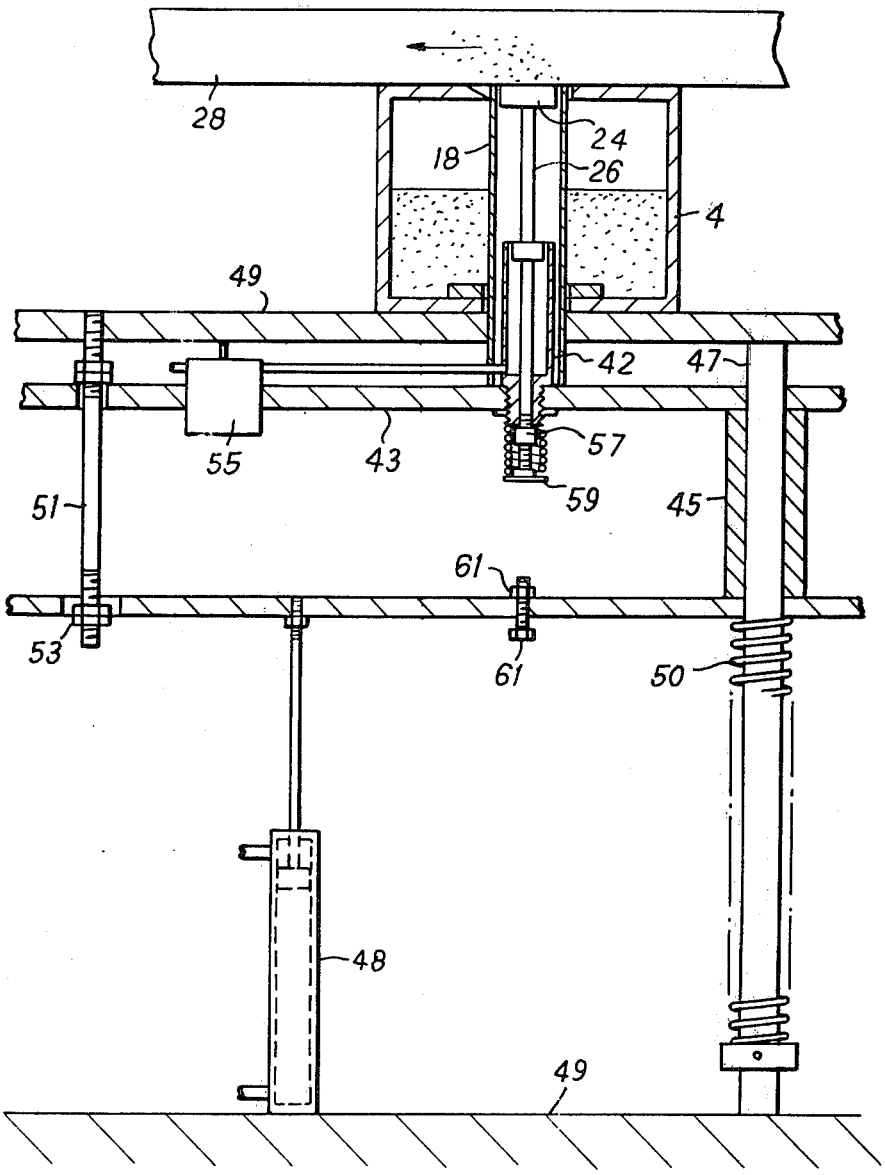
Figure 4D:
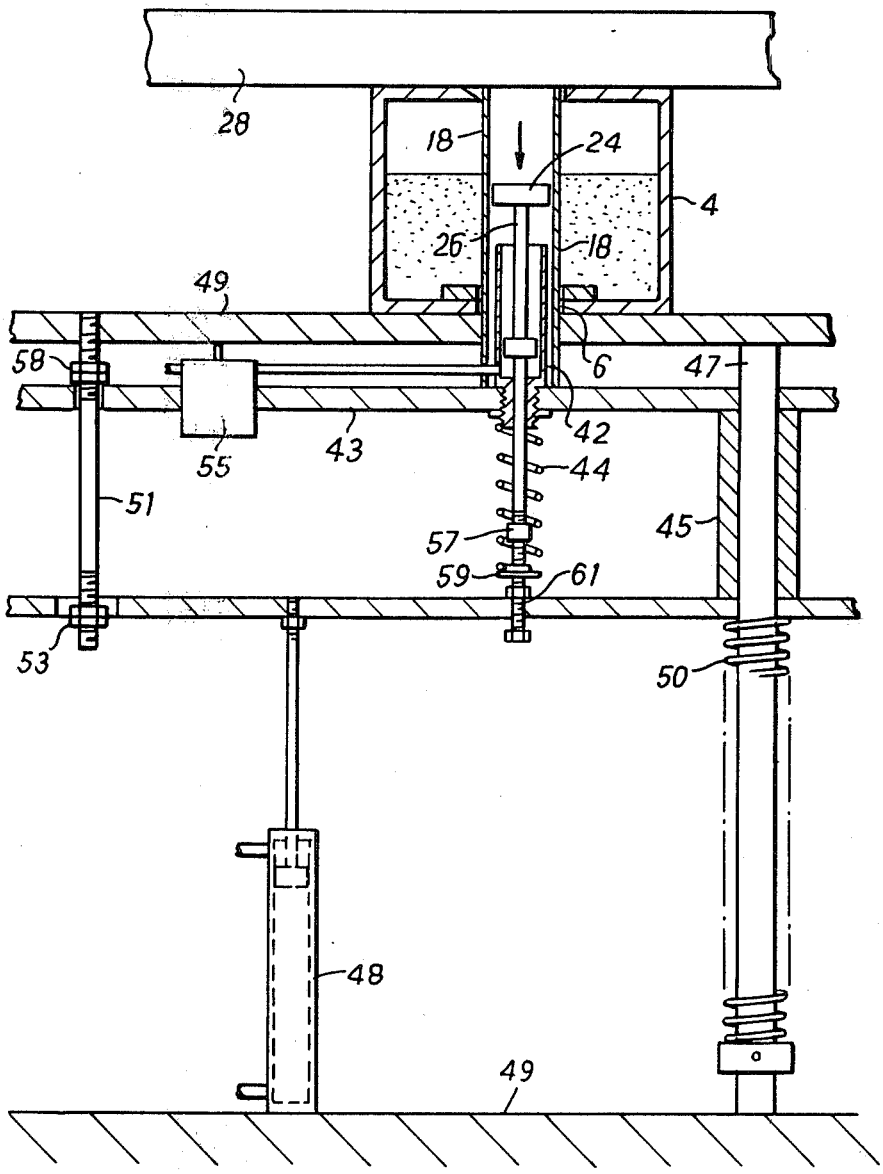

The apparatus shown in the Figures thus comprises a plurality of reservoirs of pegs comprising eight hopper chambers 2 each comprising a lower region 4 having two aligned apertures 6, 8 (see FIGS. 2 and 3). In the example, the lower region 4 is arranged to one side of the main portion of each chamber 2 and is partially divided therefrom by an adjustable baffle 10, the depth of which can be set to control the depth of the layer of pegs in the immediate vicinity of the aperture 6.

The chambers 2 are provided with a sloping floor 12 to assist in the travel of the pegs towards the regions 4. Each chamber 2 is provided with a substantially airtight lid 14, for reasons which will be hereinafter explained.

FIGS. 2 and 3 show details of one of the scoop devices 16 of the apparatus. This scoop device comprises a tubular member 18 aligned with the two apertures 6 and 8 so as to partake of a reciprocatory movement in which its lip portion 20 travels between two positions, one substantially level with the aperture 6 and the other substantially level with the aperture 8. It will be understood that the diameters of the eight tubes 18 are not necessarily all the same, account being taken of size and weight of the products when setting-up the apparatus.

Situated within each tubular member 18 is a ram member comprising a piston 24 supported on a piston rod 26. The height of this piston within the tube determines the cubic capacity of the scoop device 16 and is set in conjunction with the baffle 10 to provide sufficient volume to collect and hold the required number of pegs.

Relative movement of the piston 24 and the tubular member 18 takes place during the reciprocatory movement of the scoop device. As the scoop device 16 commences its passage from the aperture 6 to the aperture 8, the piston 24 remains relatively stationary, but as the tubular member stops when its lip portion 20 reaches the aperture 8, the piston continues its upward movement until it is approximately level with the lip portion 20. This causes the pegs collected by the scoop device 16 to be ejected into a passageway hereinafter referred to as a manifold 28 through which passes a high velocity flow of air supplied from a blower fan 30.

Pegs from all eight reservoirs are ejected simultaneously so that a correctly metered mixture of pegs is conveyed on the air flow to a conventional bagging machine 32 where the pegs are delivered into the open end of a tubular bag of polythene film and the tube heat-sealed to enclose them. It will be understood that this machine forms no part of the present invention and requires no further description.

It will be noted that the manifold 28 is D-shaped in cross-section. This shape has been found particularly advantageous for the clean, swift removal of the ejected pegs, since there is room for them to spread out laterally into the air flow as they leave the tubular member. A generous clearance is allowed between the tubular member 18 and the edges of the aperture 8 not only because of the vibratory movement of the member 18 in a manner described in more detail below, but also to prevent pegs from jamming between the member and the aperture. It will also be noted that the leeward lip of the edge of the aperture 6 is bevelled as shown in FIG. 3 to aid a clean "pick-up" by the air flow.

As mentioned previously, the capacity of the scoop device 16 is adjustable by setting the height of the piston 24 in the tube 18. Nevertheless, slight variation may occur in the rate at which the scoop device collects the pegs for ejection from one reservoir compared with a neighbouring reservoir. Such variation may be due to differences in size or shape between the pegs or whatever articles are being metered, or even due to variations in surface friction co-efficients of the same shaped pegs made from the same plastics material but coloured by different dyes. Thus the pegs having a higher resistance to "flow" into the scoop device 16 must be allowed to build up to a higher level in the region 4 on the reservoir, and this is arranged by adjustment of the baffle 10.

An operator is in attendance to keep a sufficient supply of pegs in each of the reservoirs 2, which are supplied through the lids 14. The reason why these lids are airtight is to prevent a flow of air passing from the D-shaped manifold 28 through the clearance between the tube 18 and the aperture 8, which would disturb the pegs in the region 4 and interfere with their metered collection by the scoop device 16. Moreover, the avoidance of reduction in the air flow improves the efficiency of the removal of the ejected pegs.

The speed of the air flow through the manifold 28 may be regulated according to requirements, dictated for example by the size and weight of the articles being handled, by means of adjustment of an air intake port (not shown) of the blower fan 30, which is of the centrifugal type in the present example.

An optional feature of the apparatus is the provision of a vibrator device (not shown) which causes a vibratory movement of each scoop device 16 to aid in the uniform settling of the pegs within the tube 18, should this be required. In order to accommodate the resulting vibratory movement of the tubular member 18 as it passes through the aperture 6, this aperture may be formed considerably larger than the diameter of the tubular member, and the clearance is covered by a plate through which the tubular member passes as a close fit but which is only loosely secured to the base of the reservoir region 4 by the provision of bolts passing through over-size bores in the base. This allows sideways movement of the plate, but prevents any heightwise movement.

The eight scoop devices 16 are mounted at eight side-by-side stations beneath the region 4 of the appropriate reservoir 2 in a manner to ensure simultaneous heightwise movement.

The means for actuation of the scoop device 16 will now be briefly described with reference to FIGS. 4*a–d*, which show successive stages in the operation of one of the scoop devices 16. The capacity of the device 16 is regulated by the depth to which the piston 24 is permitted to be withdrawn into the tube 18.

The mounting of the scoop devices comprises a cross frame having two steel bars 43 supported by sleeves 45 mounted for heightwise sliding movement upon vertical posts 47 (five in all) secured between top and bottom portions 49 of the machine framework. The heightwise movement which is under the control of main cylinders 48 is limited by stop rods 51 which extend downwards from the top frame portion 49 and permit movement of the steel bars 43 between two adjustable locknuts 53. This movement is steaded by compressible springs 50 mounted about each post 47.

The top frame portion 49 of course supports the scoop devices 16, the movement of the piston 24 of which is operated by a plunger valve 55, which, when the bars 43 move upwardly, comes into contact with the top frame portion 49 (see FIG. 4*b*) to depress the plunger and allow air into the bottom portion of the cylinder 42. This causes the piston 24 to move upwardly until level with the lip of the tubular member 18, thus ejecting the pegs into the manifold 28.

The upward movement of the piston 24 is controlled by an adjustable nut 57 which abuts the bottom of the cylinder 42 to compress the spring 44. When the main cylinders 48 commence their downward stroke the bars 43 descend, the plunger of the valve 55 is released, the air is released from the cylinder 42 and the spring 44 lengthens to lower the piston 24 until an abutment surface 59 abuts an adjustable stop 61.

Thus all the scoops 16 operate in unison to move, firstly, bodily upwards, followed by movement of the piston 24 only (to eject the pegs), thirdly for the piston to retract, and lastly for the scoop to move bodily downwards ready to collect the next load.

I claim:

1. Apparatus for the metering and dispensing of products comprising small articles, particulate material or the like, comprising a supply reservoir for receiving the products from a source, a first aperture situated in a lower region of the reservoir, a second aperture in said reservoir arranged in alignment with said first aperture, a scoop device, means for causing the scoop device to pass through the reservoir entering through said first aperture and passing into said second aperture, so as to collect a quantity of product during its passage between said first and second apertures, ejection means for ejecting said collected products from the scoop device so that they leave the reservoir solely through said scoop device, the ejection means comprising a ram member positioned within the scoop device, the initial position of the ram member within said scoop device at the commencement of the passage of the scoop device through the reservoir determining the amount of product by volume entering the scoop, said ram member being carried by a rod, a piston connected to said rod for moving said ram member, and said piston being mounted in a cylinder telescoped within said scoop device.

2. Apparatus according to claim 1 together with a return spring coupled to said rod remote from said ram member.

3. Apparatus according to claim 2 wherein said scoop device, said cylinder, said rod, said piston and said return spring are all carried by a common platform movable toward and away from said reservoir.

* * * * *